US005419536A

United States Patent [19]

Bender

[11] Patent Number: 5,419,536

[45] Date of Patent: May 30, 1995

[54] FENCE POST CAP

[76] Inventor: Richard Bender, Bender Mold & Machine, Inc. 55900 Hoosier Ave., Mishawaka, Ind. 46545-5198

[21] Appl. No.: 23,007

[22] Filed: Feb. 26, 1993

[51] Int. Cl.[6] ..... E04H 17/00

[52] U.S. Cl. ..... 256/1; 256/19; 52/301

[58] Field of Search ..... 256/1, 19, 32, DIG. 5, 256/73, 50, 66, 65, 47; 52/300, 301, 244

[56] References Cited

U.S. PATENT DOCUMENTS

| | | | |
|---|---|---|---|
| 1,707,397 | 4/1929 | Hurst | 52/301 X |
| 1,918,607 | 7/1933 | Lindh | 256/65 X |
| 1,964,657 | 6/1934 | Austin | 52/301 X |
| 2,541,460 | 2/1951 | Bugh | 52/301 X |
| 2,998,110 | 8/1961 | Hutzelman | 52/301 |
| 3,352,581 | 11/1967 | Robbins et al. | 52/300 X |
| 5,078,367 | 1/1992 | Simpson et al. | 256/19 X |

FOREIGN PATENT DOCUMENTS

| | | | |
|---|---|---|---|
| 131543 | 4/1902 | Germany | 52/300 |
| 1101554 | 3/1961 | Germany | 52/300 |
| 42844 | 7/1917 | Sweden | 52/301 |
| 77301 | 9/1918 | Switzerland | 52/301 |

*Primary Examiner*—Eric K. Nicholson
*Assistant Examiner*—Harry C. Kim
*Attorney, Agent, or Firm*—Barnes & Thornburg

[57] ABSTRACT

A fence post cap is provided which is formed from plastic materials and having a fastener support member, which resists cap deformation during application of the fastener and includes fluid sealing portions about the fastener, and locating studs adjacent the perimeter sides of the cap to facilitate positive seating of the cap on the fence post. The plastic material can be molded in any desired color to match or contrast the fence color. The fastener is received within a counter bore such that the fastener head is more isolated from inadvertent contact after installation.

8 Claims, 1 Drawing Sheet

FENCE POST CAP

BACKGROUND AND SUMMARY OF THE INVENTION

The present invention relates generally to caps covering the ends of longitudinally extending structural members and, more particularly, to caps covering the exposed ends of wooden fence posts.

Wooden, plastic, and metal fences are typically mounted on wooden fence posts having one end thereof sunk into the ground or secured to a support base. These fence posts are typically formed from square or rectangular cuts of wood, such as "4×4" beams. These beams extend longitudinally upward from the ground or support base and, after the fence is attached, typically have an exposed end.

The exposed ends of such fence posts are often relatively rough in appearance and texture. Also, these exposed ends can form a ledge for collection of water from rain or snow. In some circumstances such water is more readily absorbed into the post end than from any other surface and, thus, facilitates wood rot. Therefore, it has been considered advisable to cover the ends of fence posts with a cap to beautify and protect the fence as well as protect those persons and animals coming into physical contact with the fence posts from injury.

Prior fence post caps have often been formed from metal into a generally domed configuration with post-engaging perimeter sides. These caps had, in the dome area, a central hole of slightly larger dimension than the nail which was used to secure the cap to the post. When the nail was pound into the post, a depression was sometimes created in the dome area at the location of the central hole. In addition to detracting from the finished appearance of the cap, this depression formed a basin or ledge to collect water and funnel it through the central hole to the fence post end where it could again accumulate and cause premature wood rot.

Further, prior fence post caps allowed the securing nail to protrude above the dome area, at least by the thickness of the nail head. This protrusion created the potential for snags against the clothing or body of persons coming into contact with the fence post. When securing nail was pound down to reduce the incidences of snagging, a greater likelihood of creating a water collecting depression in the dome area arose.

Another difficulty with respect to prior fence caps was in maintaining precise seating on the end of the post. The recess perimeter of these caps was slightly larger than the post perimeter, and the perimeter sides generally paralleled the longitudinal direction of the post. The dome area joined the perimeter sides as an inclined surface. Thus, since the perimeter sides extended down along the posts sides for only a short distance, it was possible for the cap to be seated slightly off center on the end of the post with an edge of that end actually resting on the underside of the dome area away from the perimeter sides. Such off center seating also detracted from the desired appearance of the end post, increased the likelihood of dents being formed and, particularly as the post wood shrank over time, contributed to the susceptibility of the post cap to rattle in the wind.

Finally, prior post caps tended to present only a metallic finish because of the cost of painting and the susceptibility for the paint to flake off during installation or thereafter. Particularly with respect to all-wood fences, such metallic coloring was incongruous to the overall appearance of the fence.

Accordingly, an object of the present invention is to provide an improved fence post cap. Other specific objects of the present invention include provision of the fence post cap that:

1. more effectively shields the end of the fence post from water,
2. is less susceptible to damage during installation,
3. is less likely to cause injury to persons, animals or articles coming into contact with it,
4. seats more securely and properly on the fence post, and
5. is attractive, durable and relatively inexpensive to manufacture.

These and other objects of the present invention are attained by a fence post cap molded from plastic materials and having a fastener support member, which resists cap deformation during application of the fastener and includes fluid sealing portions about the fastener, and locating studs adjacent the perimeter sides of the cap to facilitate positive seating of the cap on the fence post. The plastic material can be molded in any desired color to match or contrast the fence color. The fastener is received within a counter bore such that the fastener head is more isolated from inadvertent contact after installation.

Other objects, advantages and novel features of the present invention will become apparent upon consideration of the drawings and specification below.

DETAILED DESCRIPTION OF PREFERRED EMBODIMENTS

Figure 1:
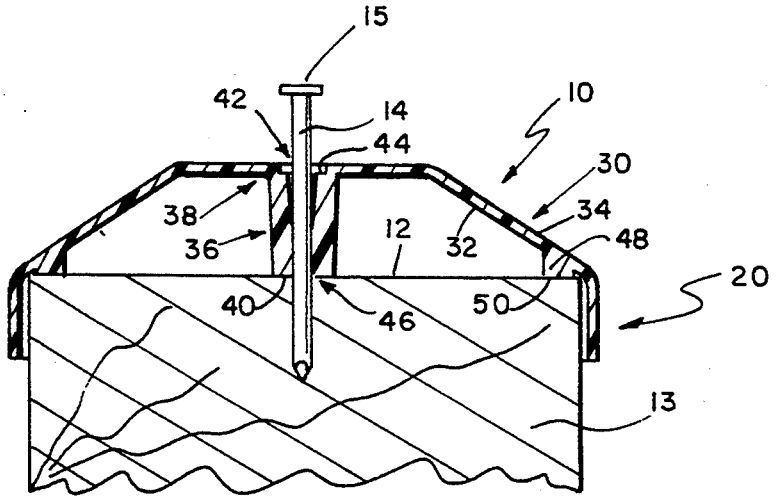
FIG. 1 is a side schematic view of a fence post cap arrangement according to the present invention.
Figure 2:
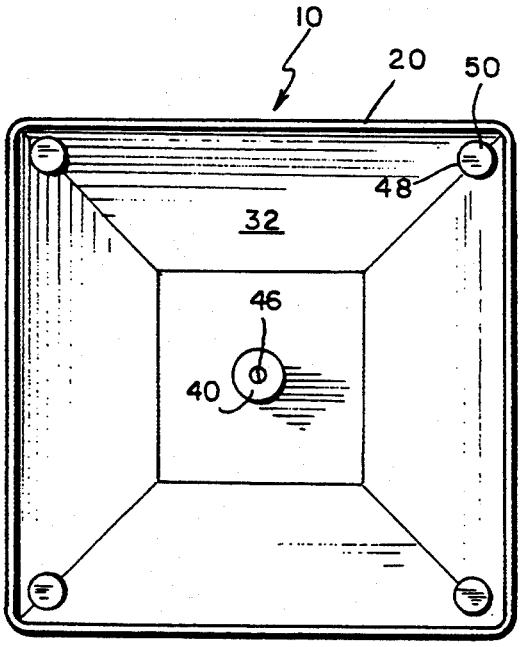
FIG. 2 is a bottom plan view of the fence post cap of FIG. 1.
Figure 3:
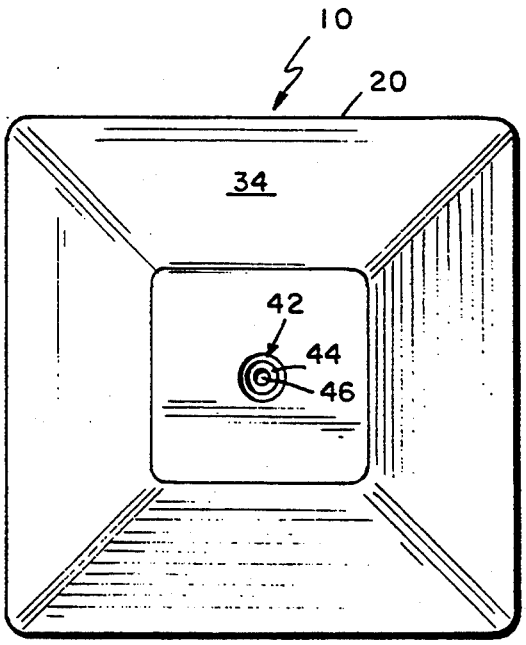
FIG. 3 is a top plan view of the fence post cap of FIG. 1.

FIG. 1, which illustrates a preferred embodiment of the present invention, shows cap 10 mounted on exposed end 12 of a fence post 13 with fastener 14 provided to secure cap 10 in the desired location. The fence post is, for example, a "4×4" beam of treated wood measuring approximately 3½ inches on each side. Thus, cap 10 would have a square sided configuration to its recess for receiving end 12. Fastener 14 is, for example, a galvanized steel nail of sufficient length to pass through cap 10 and well into end 12 in the same manner as with prior fence post caps.

Cap 10 includes perimeter sides 20 and dome area 30. Perimeter sides 20 are preferably dimensioned to closely overlay for a short distance the longitudinally extending sides of fence post 13 near end 12. Thus, perimeter sides 20 limit exposure of end 12 to inclement weather, such as rain and snow. Dome area 30 spans perimeter sides 20 as a generally concave surface having an underside 32 and an exposed side 34. Thus, a recess is formed by cap 10 for receiving and covering end 12 therein. Preferably, as viewed in a longitudinal cross section, dome area 30 is trapazoidal in configuration, forming a truncated pyramid from a top or side plan view.

Support member 36 is formed on underside 32 and extends downwardly to the level at which perimeter sides 20 join dome area 30. Support member 36 is, for example, a hollow column having a base 38 at the region it joins underside 32 and a support surface 40 at its furthest extension from underside 32. Preferably, base 38 is wider in diameter than support surface 40 and the hollow column tapers evenly between these diameters.

Base 38 is formed with an aperture 42 for receiving fastener 14 and a ledge 44 about aperture 42 which is recessed below exposed side 34. Aperture 42 is preferably slightly wider in its diameter than the diameter of that portion of fastener 14 which passes through cap 10 and penetrates end 12. Ledge 44 is preferably slightly wider in its diameter than head 15 of fastener 14 and slightly deeper in recession below exposed side 34 than the thickness of head 15. Thus, upon full insertion of fastener 14 into aperture 42, head 15 will rest on ledge 44 and be countersunk to or slightly below the level of exposed side 34.

Support surface 40 is formed with an aperture 46 for receiving a length of fastener 14. Aperture 46 is preferably initially slightly smaller in its diameter than the diameter of that portion of fastener 14 which would remain within aperture 46 after full insertion of fastener 14 into aperture 42. Thus, penetration of aperture 46 by fastener 14 will initially be resisted by aperture 42 and later result in a close, interference fit of support member 36 about fastener 14.

A plurality of locating studs or projections 48 are formed on underside 32 adjacent perimeter sides 20. Projections 48 are, for example, cylindrical columns spaced apart from perimeter sides 20 and extending downwardly to the level at which perimeter sides 20 join dome area 30. Flat surfaces 50 are formed at the furthest extension of projections 48 from domed area 30.

Cap 10 is preferably molded as an integral unit from plastic material, such as APG 112 polypropylene, in any desired color. This material has been found to be sufficiently flexible and water impervious that a water seal is created at the juncture of ledge 44 and head 15 as well as at the engagement of fastener 14 and aperture 46. In the orientation shown in FIG. 1, the former seal is along a horizontal plane and the latter seal is vertically oriented.

At the same time, in the preferred configuration such plastic material has been found to be sufficiently sturdy so as to resist denting or breaking as fastener 14 is secured, typically by hammering, into fence post 13. For example, support member 36 helps the top of dome area 30 resist permanent depression when fastener 14 is being pound.

When end 12 is fully inserted within the recess of cap 10, flat surfaces 50 and support surface 40 preferably rest on or adjacent end 12. These surfaces assist in positively locating fence post 13 within cap 10, particularly when perimeter sides 20 overlay fence post 13 for a relatively short longitudinal distance. For example, and especially in those embodiments where support member 36 is omitted or a shorter length than in the embodiment of FIG. 1, projections 48 can prevent one side or edge of end 12 from penetrating cap 10 too far and riding up underside 32 above the level at which perimeter sides 20 join dome area 30. Further, in those embodiments where cap 10 is molded from plastic, projections 48 can serve additionally as ejection points for removal of cap 10 from the mold during the fabrication process.

Although embodiments of the present invention have been described herein in detail, that description is by way of example and not as limitation. Those of ordinary skill in the art will now readily understand that various modifications of structure can be made to permit various embodiments of the present invention. For example, although two fluid seals are shown in support member 36, one or both of these seals may be omitted in specific embodiments. Also, the recess of cap 10 can be formed in other configurations to fit over fence post ends having other configurations. Further, fastener 14 has been shown herein as a standard, cylindrical nail. If a differently shaped fastener is used, apertures 42 and 46 can be configured correspondingly to provide the same functions as the embodiments shown herein. Accordingly, the spirit and scope of the present invention is limited only by the terms of the claims defined below.

What is claimed is:

1. A cap, for attachment to an end of a fence post, comprising:

a surface which overlays said end at least in part, an aperture in said surface for receiving a fastener element which attaches to said end and secures said surface with respect to said end, and a columnar support means, adjacent said aperture and extending from said surface to a top surface of said end, for restricting deformation of said surface as a result of attachment of said fastener element to said end.

2. The cap according to claim 1 wherein said support means includes sealing means for preventing fluid seepage through said aperture.

3. The cap according to claim 2 wherein said surface includes means to facilitate positive location of said surface with respect to said end.

4. A cap assembly adapted to receive a top surface of an exposed end of a rectangular fence post, comprising:

a generally concave surface having an underside defined within the concavity and an exposed side exterior of the concavity, a support means attached to said underside and having a generally columnar configuration dimensioned such that one end of said support means rests on said top surface when said fence post is fully received within said cap assembly, an elongate fastener element adapted to penetrate said top surface and thereby retain said cap to said post, and a passageway through said support means for receiving said fastener element, said passageway including sealing means adjacent each end thereof for restricting the flow of fluid through said passageway when said fastener element is received therein.

5. The cap assembly according to claim 4 wherein said passageway is dimensioned so as to fully receive said fastener element such that substantially no portion of said fastener element protrudes above said exposed side, and said support means is sufficiently rigid to withstand forces exerted on said fastener element to cause penetration of said top surface by said fastener element without causing permanent deformation of said exposed side adjacent said passageway.

6. A cap arrangement, for receiving an end of a post or other longitudinally extending protrusion, comprising:

a recess configured to receive and cover a longitudinally extending portion of said end of a post, said recess including a perimeter portion configured to closely overlay said longitudinally extending portion for a given distance and defining the opening of said recess, said recess also including a cover portion spanning said perimeter portion, said cover portion including a plurality of projections thereon for engagement with a top surface of said end of a post to limit the penetration of said recess by said portion of said end of a post, and a columnar support member extending from said cover portion to said top surface of said end of a post.

7. The cap arrangement according to claim 6 wherein a fastener is provided for penetrating said top surface and thereby securing said cover to said post, said cover being provided with an aperture arrangement for receiving said fastener, and said aperture arrangement being provided with at least first and second fluid sealing means to restrict fluid flow through said aperture.

8. The cap arrangement according to claim 7 wherein said first fluid sealing means restricts fluid flow in a first direction, said second fluid sealing means restricts fluid flow in a second direction, and said first direction is substantially orthogonal to said second direction.

* * * * *